US009289823B2

(12) United States Patent
Bochiechio et al.

(10) Patent No.: US 9,289,823 B2
(45) Date of Patent: Mar. 22, 2016

(54) DIE CASTING SYSTEM AND CELL

(71) Applicant: UNITED TECHNOLOGIES CORPORATION, Hartford, CT (US)

(72) Inventors: Mario P. Bochiechio, Vernon, CT (US); John Joseph Marcin, Marlborough, CT (US); Carl R. Verner, Windsor, CT (US); John F. Blondin, South Windsor, CT (US); Mark F. Bartholomew, Enfield, CT (US); Raymond P. Ristau, South Windsor, CT (US); Kevin W. Chittenden, Oxford, AL (US); Gary M. Tamiso, East Hartford, CT (US); Robert C. Renaud, Southbridge, MA (US); Dennis M. Kraemer, Coventry, CT (US); Robert E. LeBrun, Southington, CT (US); Paul R. Zamjohn, Saco, ME (US); Charles A. Roohr, North Granby, CT (US); Kerry Kozaczuk, West Hartford, CT (US); Roy A. Garrison, Chaplin, CT (US); Steven J. Bullied, Pomfret Center, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 14/536,950

(22) Filed: Nov. 10, 2014

(65) Prior Publication Data

US 2015/0060002 A1 Mar. 5, 2015

Related U.S. Application Data

(62) Division of application No. 13/030,225, filed on Feb. 18, 2011, now Pat. No. 8,919,422.

(51) Int. Cl.
*B22D 17/02* (2006.01)
*B22D 17/14* (2006.01)

(Continued)

(52) U.S. Cl.
CPC ..... *B22D 17/02* (2013.01); *B22D 17/14* (2013.01); *B22D 17/2076* (2013.01);
(Continued)

(58) Field of Classification Search
CPC .... B22D 17/00; B22D 17/0204; B22D 17/14; B22D 17/2076; B22D 17/22; B22D 29/00; B22D 29/03
See application file for complete search history.

(56) References Cited

U.S. PATENT DOCUMENTS 3,209,416 A 10/1965 Morton
3,900,064 A 8/1975 Chandley et al.

(Continued)

FOREIGN PATENT DOCUMENTS

CN 101954470 A 1/2011
EP 1013363 B1 3/2005

(Continued)

OTHER PUBLICATIONS

Singapore Written Opinion and Search Report for Singapore Application No. 201200134-3 dated Aug. 21, 2012.

(Continued)

*Primary Examiner* — Kevin P Kerns
*Assistant Examiner* — Steven Ha
(74) *Attorney, Agent, or Firm* — Carlson, Gaskey & Olds

(57) ABSTRACT

A method of manufacturing a component in a die casting cell that includes a die casting system according to an exemplary aspect of the present disclosure includes, among other things, isolating a first chamber from a second chamber of the die casting system, melting a charge of material in the first chamber, sealing the second chamber relative to the first chamber, and simultaneously injecting the charge of material within the second chamber to cast the component and melting a second charge of material within the first chamber.

18 Claims, 5 Drawing Sheets

(51) Int. Cl.

| | |
|---|---|
| ***B22D 17/28*** | (2006.01) |
| ***B22D 17/30*** | (2006.01) |
| ***B22D 17/20*** | (2006.01) |
| ***B22D 17/22*** | (2006.01) |
| ***B22D 25/02*** | (2006.01) |
| ***B22D 29/00*** | (2006.01) |
| ***B22D 31/00*** | (2006.01) |

(52) U.S. Cl.

CPC ..... *B22D 17/22* (2013.01); *B22D 17/28* (2013.01); *B22D 17/30* (2013.01); *B22D 25/02* (2013.01); *B22D 29/00* (2013.01); *B22D 31/002* (2013.01)

(56) References Cited

U.S. PATENT DOCUMENTS

| | | | | |
|---|---|---|---|---|
| 4,154,286 | A | | 5/1979 | Glazunov et al. |
| 4,484,614 | A | * | 11/1984 | Maringer ..... 164/463 |
| 4,842,038 | A | | 6/1989 | Fujino et al. |
| 5,219,409 | A | | 6/1993 | Campbell et al. |
| 5,329,983 | A | | 7/1994 | Cook |
| 5,711,363 | A | | 1/1998 | Scruggs et al. |
| 5,860,468 | A | | 1/1999 | Cook |
| 6,210,628 | B1 | | 4/2001 | Booth et al. |
| 6,405,786 | B1 | | 6/2002 | Ratte |
| 6,553,667 | B1 | * | 4/2003 | West ..... 29/896.412 |
| 6,951,238 | B2 | | 10/2005 | Hirai et al. |
| 2001/0002617 | A1 | * | 6/2001 | Schofield et al. ..... 164/61 |
| 2007/0137827 | A1 | * | 6/2007 | Vogt et al. ..... 164/113 |
| 2009/0160106 | A1 | * | 6/2009 | Graves et al. ..... 266/46 |
| 2012/0119461 | A1 | | 5/2012 | Heinecke et al. |

FOREIGN PATENT DOCUMENTS

| | | | |
|---|---|---|---|
| EP | 1152851 | B1 | 8/2007 |
| EP | 1900456 | A1 | 3/2008 |
| JP | 60009563 | A | 1/1985 |
| JP | 01247984 | A | 10/1989 |
| WO | 9010516 | | 9/1990 |

OTHER PUBLICATIONS

Singapore Examination Report for Application No. 201200134-3 dated Apr. 8, 2013.

* cited by examiner

DIE CASTING SYSTEM AND CELL

CROSS REFERENCE TO RELATED APPLICATIONS

This application is a divisional of U.S. patent application Ser. No. 13/030,225, filed Feb. 18, 2011.

BACKGROUND

This disclosure relates generally to die casting systems, and more particularly to a die casting system and cell.

Casting is a known technique used to yield near net-shaped components. For example, investment casting is often used in the gas turbine engine industry to manufacture near net-shaped components, such as blades and vanes having relatively complex geometries. A component is investment cast by pouring molten metal into a ceramic shell having a cavity in the shape of the component to be cast. Generally, the shape of the component to be cast is derived from a wax pattern or SLA pattern that defines the shape of the component. The investment casting process is capital intensive, requires significant manual labor and can be time intensive to produce the final component.

Die casting offers another known casting technique. Die casting involves injecting molten metal directly into a reusable die to yield a near net shaped component. The cycle time to melt an alloy for use in the die casting process is relatively high. Accordingly, the cycle time can affect the length of time the die casing system components are subjected to relatively high thermal loads and stresses during the die casting process.

SUMMARY

A method of manufacturing a component in a die casting cell that includes a die casting system according to an exemplary aspect of the present disclosure includes, among other things, isolating a first chamber from a second chamber of the die casting system, melting a charge of material in the first chamber, sealing the second chamber relative to the first chamber, and simultaneously injecting the charge of material within the second chamber to cast the component and melting a second charge of material within the first chamber.

In a further non-limiting embodiment of the foregoing method, the method includes removing the component from the die with a robot, delivering the component to a post-cast station with the robot, and performing a secondary operation on the component at the post-cast station.

In a further non-limiting embodiment of either of the foregoing methods, the method includes melting the charge of material into molten metal with at least one electron beam melting gun.

In a further non-limiting embodiment of any of the foregoing methods, the step of melting includes preheating the charge of material with the at least one electron beam melting gun, focusing a beam of the at least one electron beam melting gun onto a tip of the charge of material and melting the charge of material into a crucible.

In a further non-limiting embodiment of any of the foregoing methods, the step of melting includes superheating the charge of material within the crucible.

In a further non-limiting embodiment of any of the foregoing methods, the method includes applying a vacuum to the first chamber and the second chamber.

In a further non-limiting embodiment of any of the foregoing methods, the step of isolating includes closing an isolation valve to separate the first chamber from the second chamber.

In a further non-limiting embodiment of any of the foregoing methods, the step of sealing includes closing a shut-off mechanism to seal a shot tube of the die casting system from a melting system of the die casting system.

In a further non-limiting embodiment of any of the foregoing methods, the step of melting includes communicating the charge of material to the first chamber and positioning the charge of material relative to a melting unit.

In a further non-limiting embodiment of any of the foregoing methods, the step of simultaneously injecting the charge of material within the second chamber to cast the component and melting the second charge of material with the first chamber includes actuating a shot tube plunger to force the charge of material into a die of the die casting system within the second chamber and melting the second charge of material with a melting unit housed in the first chamber.

A method of manufacturing a component in a die casting cell that includes a die casting system according to another exemplary aspect of the present disclosure includes, among other things, isolating a first chamber from a second chamber of the die casting system, drawing a vacuum in the first chamber, melting a charge of material within the first chamber, communicating the charge of material to a shot tube of the die casting system and injecting the charge of material into a die of the die casting system to cast the component.

In a further non-limiting embodiment of the foregoing method, the step of isolating includes closing an isolation valve to separate the first chamber from the second chamber.

In a further non-limiting embodiment of either of the foregoing methods, the method includes opening the isolation valve after the step of drawing the vacuum to reach equilibrium between the first chamber and the second chamber, and after equilibrium is reached, performing the step of communicating the charge of material.

In a further non-limiting embodiment of any of the foregoing methods, the method includes actuating a shut-off mechanism to seal the shot tube from a melting system of the die casting system.

In a further non-limiting embodiment of any of the foregoing methods, the method includes, after solidification of the component, venting the second chamber and opening an isolation valve to remove the component from the die.

A method of manufacturing a component in a die casting cell that includes a die casting system according to another exemplary aspect of the present disclosure includes, among other things, die casting a gas turbine engine component using the die casting system, removing the gas turbine engine component from the die casting system with a robot, delivering the gas turbine engine component to a post-cast station with the robot and performing a secondary operation on the gas turbine engine component at the post-cast station.

In a further non-limiting embodiment of the foregoing method, the post-cast station includes a gate cut-off station.

In a further non-limiting embodiment of either of the foregoing methods, the post-cast station includes a belt grinding station.

In a further non-limiting embodiment of any of the foregoing methods, the post-cast station includes a grit blast station.

In a further non-limiting embodiment of any of the foregoing methods, the post-cast station includes an inspection station.

The various features and advantages of this disclosure will become apparent to those skilled in the art from the following detailed description. The drawings that accompany the detailed description can be briefly described as follows.

DETAILED DESCRIPTION

Figure 1:
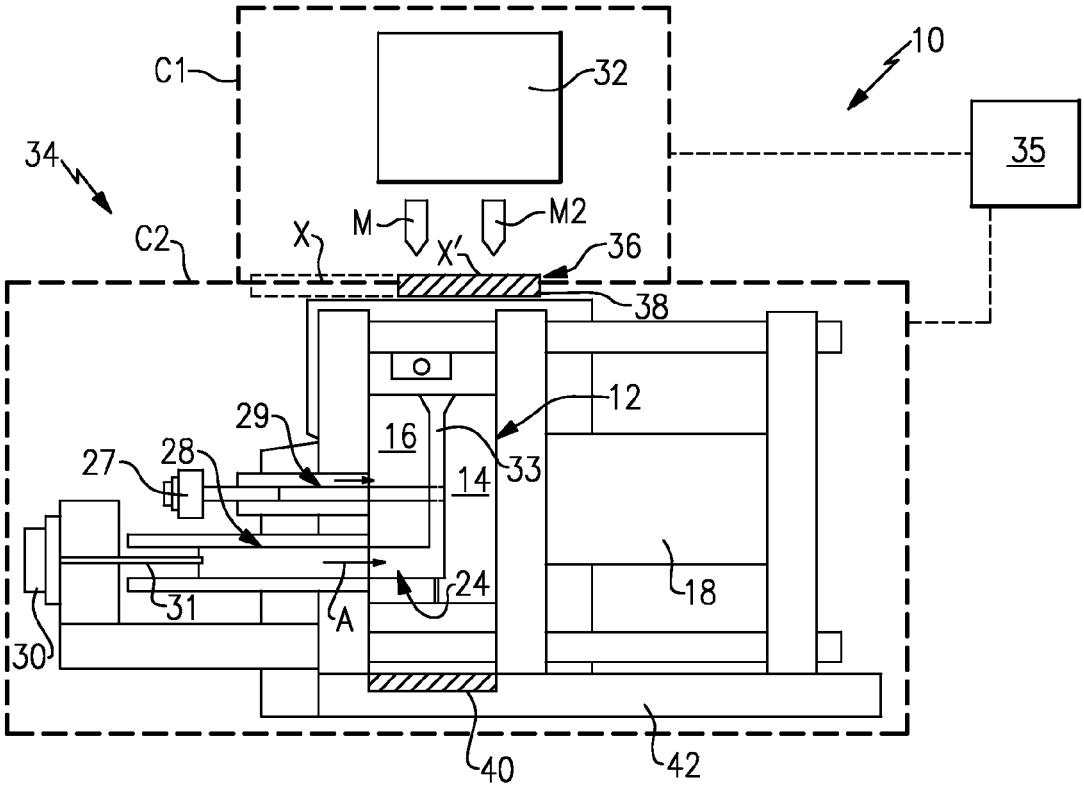
FIG. 1 illustrates an example die casting system.
Figure 2:
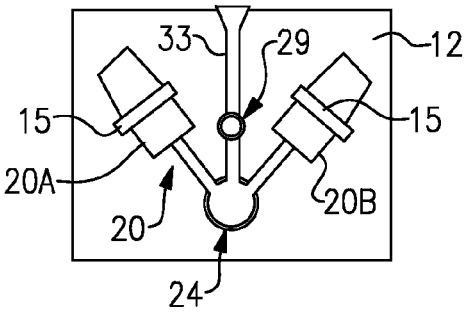
FIG. 2 illustrates a portion of a die casting system including a die having a die cavity.

FIG. 1 illustrates a die casting system 10 including a reusable die 12 having a plurality of die elements 14, 16 that function to cast one or more components 15 (See FIG. 2). The components 15 could include aeronautical components, such as gas turbine engine blades or vanes, or non-aeronautical components. Although two die elements 14, 16 are depicted by FIG. 1, it should be understood that the die 12 could include more or fewer die elements, as well as other parts and other configurations.

The die 12 is assembled by positioning the die elements 14, 16 together and holding the die elements 14, 16 at a desired position via a mechanism 18. The mechanism could include a clamping mechanism that may be powered hydraulically, pneumatically, electromechanically or with other power systems. The mechanism 18 also separates the die elements 14, 16 subsequent to casting.

The die elements 14, 16 include internal surfaces that cooperate to define a die cavity 20 (See FIG. 2). The die cavity 20 defines two cavities 20A and 20B, in this example. However, the die cavity 20 could include fewer or additional cavities.

A shot tube 24 is in fluid communication with the die cavity 20. In this example, at least a portion of the shot tube 24 is integral to the die 12. However, the shot tube 24, or at least a portion thereof, can also be located external to the die 12. A shot tube plunger 28 is received within the shot tube 24 and is moveable between a retracted and injected position (in the direction of arrow A) within the shot tube 24 by a mechanism 30. A shot rod 31 extends between the mechanism 30 and the shot tube plunger 28. The mechanism 30 could include a hydraulic assembly or other suitable system, including, but not limited to, pneumatic, electromechanical, hydraulic or any combination of systems.

The shot tube 24 is positioned to receive a charge of material M from a melting system 32 (shown schematically). Example melting systems are described below. The melting system 32 melts a charge of material M, such as an ingot of metallic material, and delivers molten metal to the shot tube 24. In this example, the die 12 includes a runner 33 that communicates the charge of material M from the melting system 32 to the shot tube 24. However, the charge of material M can also be delivered directly to the shot tube 24, as is discussed in greater detail with respect to FIG. 6.

A sufficient amount of molten metal is delivered to the shot tube 24 to fill the die cavity 20. The charge of material M can include, but is not limited to, various metallic materials including nickel-based super alloys, cobalt-based super alloys, titanium alloys, high temperature aluminum alloys, copper-based alloys, iron alloys, molybdenum, tungsten, niobium or other refractory metals. This disclosure is not limited to the disclosed alloys, and other high melting temperature materials may be utilized to die cast a component 15. As used in this disclosure, the term "high melting temperature material" is intended to include materials having a melting temperature of approximately 1500° F./850° C. and higher.

The example die casting system 10 further includes a shut-off mechanism 29 that is selectively retractable between an open position and a closed position (shown in phantom lines) by a mechanism 27. For example, the shut-off mechanism 29 could include a wedge, a cylinder, a cone or other suitable mechanism for closing off the runner 33. The shut-off mechanism 29 is actuated to separate the entry point of the charge of material M from the shot tube 24. In other words, the shut-off mechanism 29 seals the shot tube 24 from the melting system 32. In this way, a second charge of material M2 can be prepared for delivery to the shot tube 24 simultaneously with the injection of the first charge of material M to cast a component 15, thereby reducing cycle time of the die casting system 10.

The shot tube plunger 28 is actuated to inject the charge of material M under pressure from the shot tube 24 to the die cavity 20 to cast the component(s) 15. In this example, multiple components 15 are cast in a single shot. However, the die casting system 10 could be configured to cast any number of components in a single shot.

The die casting system 10 includes a vacuum system 34. In this example, the vacuum system 34 includes multiple chambers that are separated to facilitate the rapid production of components. In this example, the vacuum system 34 includes a first chamber C1 and a second chamber C2. Although two chambers are shown and described, the vacuum system 34 could include a single chamber or a multitude of chambers.

In this example, the first chamber C1 substantially encloses the melting system 32, while the second chamber C2 substantially encloses the die 12, the shot tube 24 and the shot tube plunger 28. A portion of melting system 32, the die 12, the shot tube 24 or the shot tube plunger 28 may be disposed outside of the first chamber C1 or second chamber C2 and still be considered "substantially enclosed."

The vacuum system 34 includes a vacuum source 35 that applies a vacuum to the first chamber C1 and the second chamber C2. In this example, a single vacuum source 35 applies vacuum to both the first chamber C1 and the second chamber C2. Alternatively, separate vacuum sources 35 may be utilized to apply vacuum to the separate chambers C1, C2 of the vacuum system 34.

In one example, the vacuum system 34 selectively applies a pressure of in the range of $5\times10^{-3}$ to $1\times10^{-6}$ Torr (0.6666 to 0.000133 Pascal) within the first chamber C1 and the second chamber C2. Other pressures are contemplated as within the scope of this disclosure. Each chamber C1, C2 may be maintained at the same or differing vacuum levels. The actual pressure applied by the vacuum system 34 will vary based on the type of component being cast and the alloy being cast, among other conditions and factors. The vacuum source 35 can include a roughing pump, a booster pump, a diffusion and/or turbo pump or other sources for achieving and maintaining a desired vacuum level within the first chamber C1 and the second chamber C2.

The vacuum system 34 creates a non-reactive environment that reduces reaction, contamination or other conditions that could detrimentally affect the quality of the cast component, such as excess porosity that could occur from expose to air. In addition, the separate chambers C1 and C2 of the vacuum system 34 facilitate the rapid production of cast components by providing the ability to melt a charge of material M in the melting system 32 simultaneously with casting and removal of a component 15 from the die cavity 20.

Figure 6:
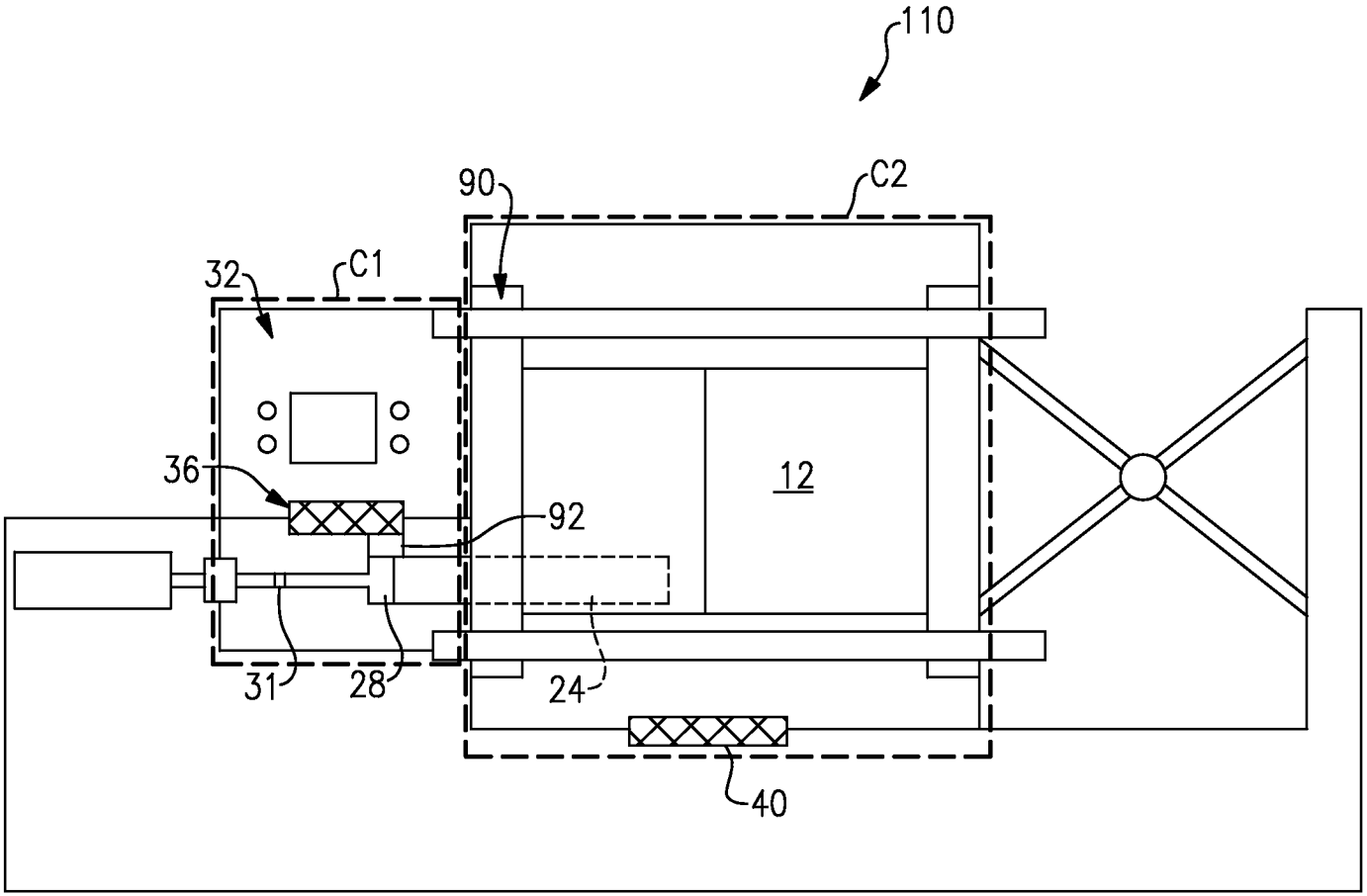
FIG. 6 illustrates another example die casting system.

The example die casting system 10 is a vertical die casting system, although other configurations are contemplated as within the scope of this disclosure (See FIG. 6, for example). The first chamber C1 is positioned vertically above the second chamber C2, in this embodiment. In other words, the melting system 32 is positioned vertically above the die 12 to provide a die casting system 10 having a vertical configuration.

Figure 3:
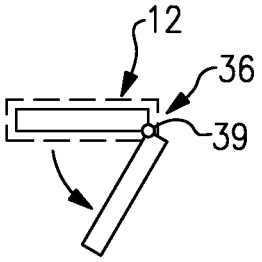
FIG. 3 illustrates an isolation valve of a die casting system.

An isolation valve 36 is positioned between the first chamber C1 and the second chamber C2 to separate the two chambers. The isolation valve 36 is selectively actuable to isolate the first chamber C1 from the second chamber C2. The isolation valve 36 can include a plate 38 that is slidable between a first position X (an open position) and a second position X' (a closed position). Alternatively, the plate 38 could rotate about a pivot point 39 to selectively isolate the first chamber C1 from the second chamber C2 (See FIG. 3).

A second isolation valve 40 can be positioned between the die 12 and a machine base 42 to provide access to the die cavity 20, as is discussed in greater detail below. Similar to the isolation valve 36, the second isolation valve 40 is selectively moveable between an open position and a closed position to provide access to the die cavity 20 of the die 12 for component removal.

Figure 4A:
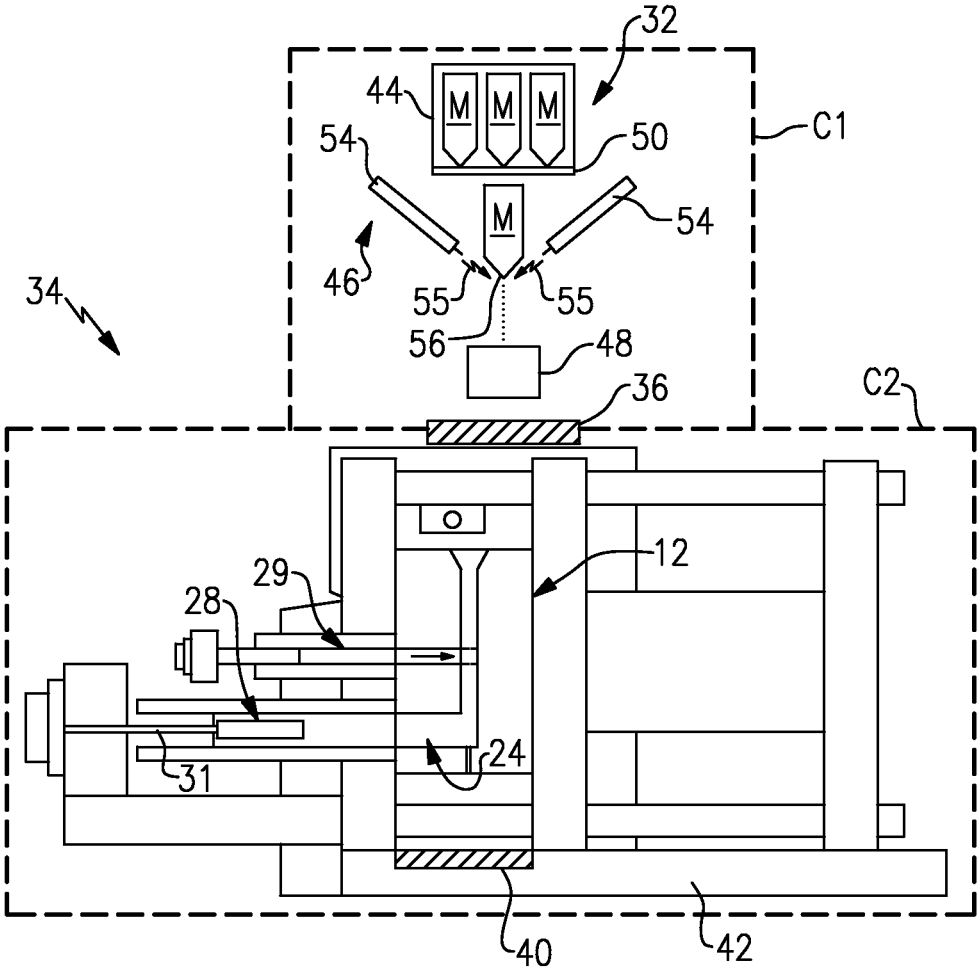
FIGS. 4A and 4B illustrate example melting systems for use with a die casting system.

FIG. 4A illustrates an example melting system 32 for use with a die casting system, such as the die casting system 10. The melting system 32 includes an alloy loader 44, a melting unit 46 and a crucible 48. The alloy loader 44, the melting unit 46 and the crucible 48 are each substantially enclosed within the first chamber C1 of the vacuum system 34.

In one example, the alloy loader 44 is a continuous alloy loader having a conveyor 50 that communicates the charge of material M to the first chamber C1 and positions the charge of material M relative to the melting unit 46 for melting the charge of material M. The alloy loader 44 could include its own isolation valve to seal any portion of the conveyor 50 that extends exteriorly from the first chamber C1.

Figure 4B:
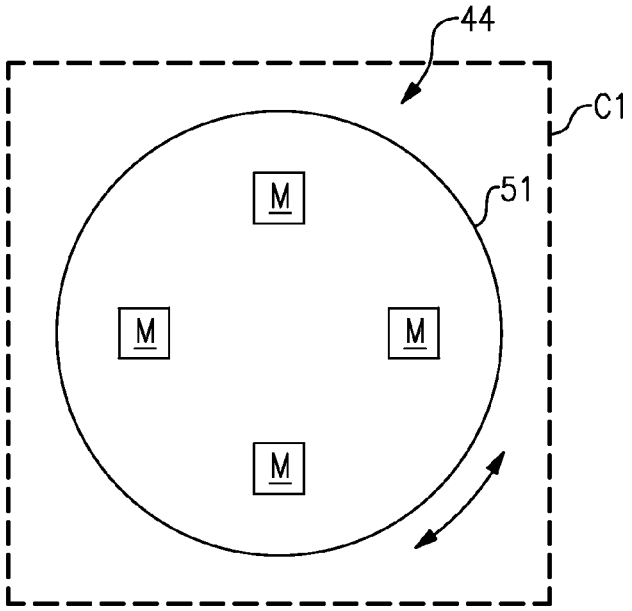

Alternatively, the alloy loader 44 includes an alloy carousel 51 (see FIG. 4B) that can be removably positioned within the first chamber C1 to load multiple charges of material M at once. The alloy carousel 51 rotates to locate each charge of material M at a desired positioning relative to the melting unit 46. The alloy carousel 51 is removed from the first chamber C1 when empty and can be loaded with additional charges of material M as needed during the die casting process.

In the example illustrated by FIG. 4A, the melting unit 46 includes a plurality of electron beam melting guns 54. Two electron beam melting guns 54 are depicted by FIG. 4A. However, the melting unit 46 could utilize a single electron beam melting gun or a plurality of electron beam melting guns. The electron beam melting guns 54 can include internal isolation valves. Alternatively, separate isolation valves may be positioned within the first chamber C1 so that each individual electron beam melting gun 54 can be removed from the first chamber C1 without the need to re-pressurize the entire first chamber C1.

Prior to melting a charge of material M, the first chamber C1 is sealed relative to the second chamber C2 via the isolation valve 36 and vacuum is drawn by the vacuum system 34. The electron beam melting guns 54 preheat the charge of material M to reduce melt time. After preheating the charge of material M, beams 55 of the electron beam melting guns 54 focus on a tip 56 of the charge of material M. As the charge of material M melts, molten metal is communicated to the crucible 48, which is positioned beneath the charge of material M.

In this example, the crucible 48 is a water cooled copper crucible, although other crucible types are contemplated. The crucible 48 can include a load sensor that detects a weight of the charge of material M. Once the charge of material M is communicated to the crucible 48, the beams 55 of the electron beam melting guns 54 are directed onto the crucible 48 to superheat the charge of material M once the load sensor indicates that a desired weight is achieved.

Once a suitable vacuum is achieved within the first chamber C1, the isolation valve 36 is opened so that the first chamber C1 and the second chamber C2 reach equilibrium. After equilibrium is reached, the charge of material M is communicated to the shot tube 24. The shut-off mechanism 29 is then closed. The shot tube plunger 28 is next actuated to force the charge of material M into the die cavity 20 to cast a component 15. After a sufficient amount of time passes for the component 15 to adequately solidify, the second chamber C2 is vented and the second isolation valve 40 is opened to allow removal of the component 15 from the die 12.

Figure 5:
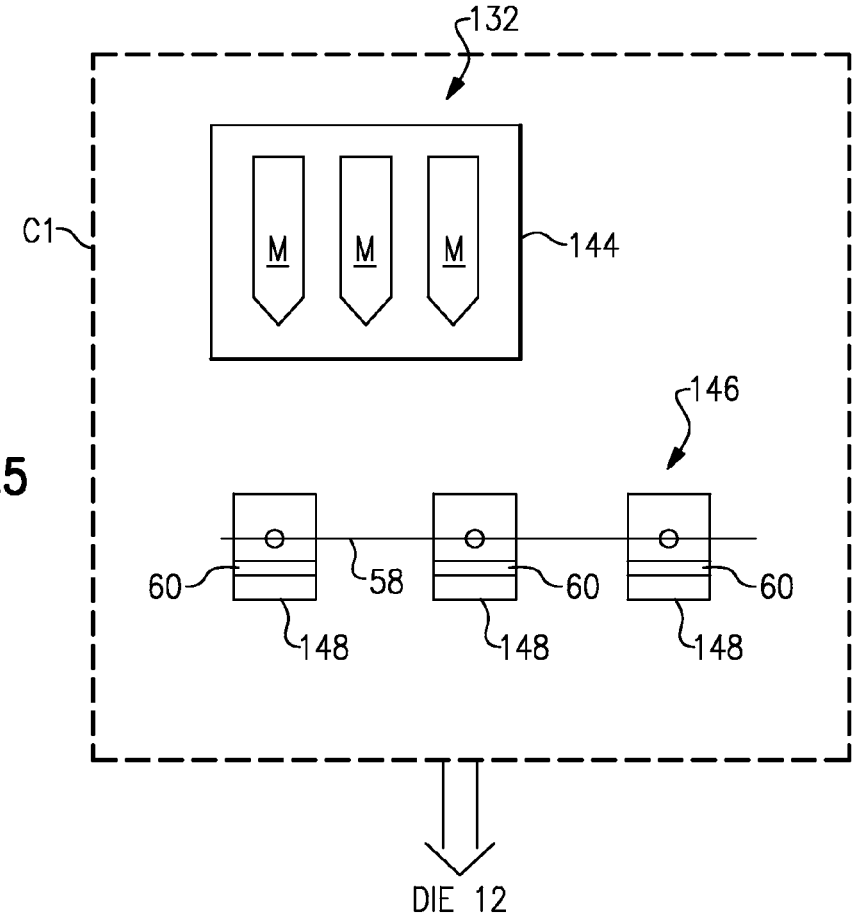
FIG. 5 illustrates another example melting system for use with a die casting system.

FIG. 5 illustrates a second example melting system 132. In this disclosure, like reference numerals signify similar features, and reference numerals identified in multiples of 100 signify slightly modified features. Moreover, selected features of one example embodiment may be combined with selected features of other example embodiments within the scope of this disclosure.

In this example, the melting system 132 includes a melting unit 146 and a plurality of crucibles 148. An alloy loader 144 may be used to load charges of material M into the plurality of crucibles 148. In this example, the melting unit 146 includes an induction melting system having coils 60 for heating the plurality of crucibles 148. Other melting units are also contemplated as within the scope of this disclosure. The plurality of crucibles 148 are positioned on a rotating platform 58, such as in a lazy susan configuration, to position each crucible 148 at a desired location within the first chamber C1 for delivery to the die 12.

FIG. 6 illustrates another example die casting system 110. In this example, the die casting system 110 is a horizontal die casting system. That is, the first chamber C1 is axially offset relative to the second chamber C2 rather than vertically above the second chamber C2. A stationary platen 90 divides the first chamber C1 from the second chamber C2. The melting system 32 can direct a charge of material M directly into the shot tube 24, such as through a pour hole 92.

Figure 7:
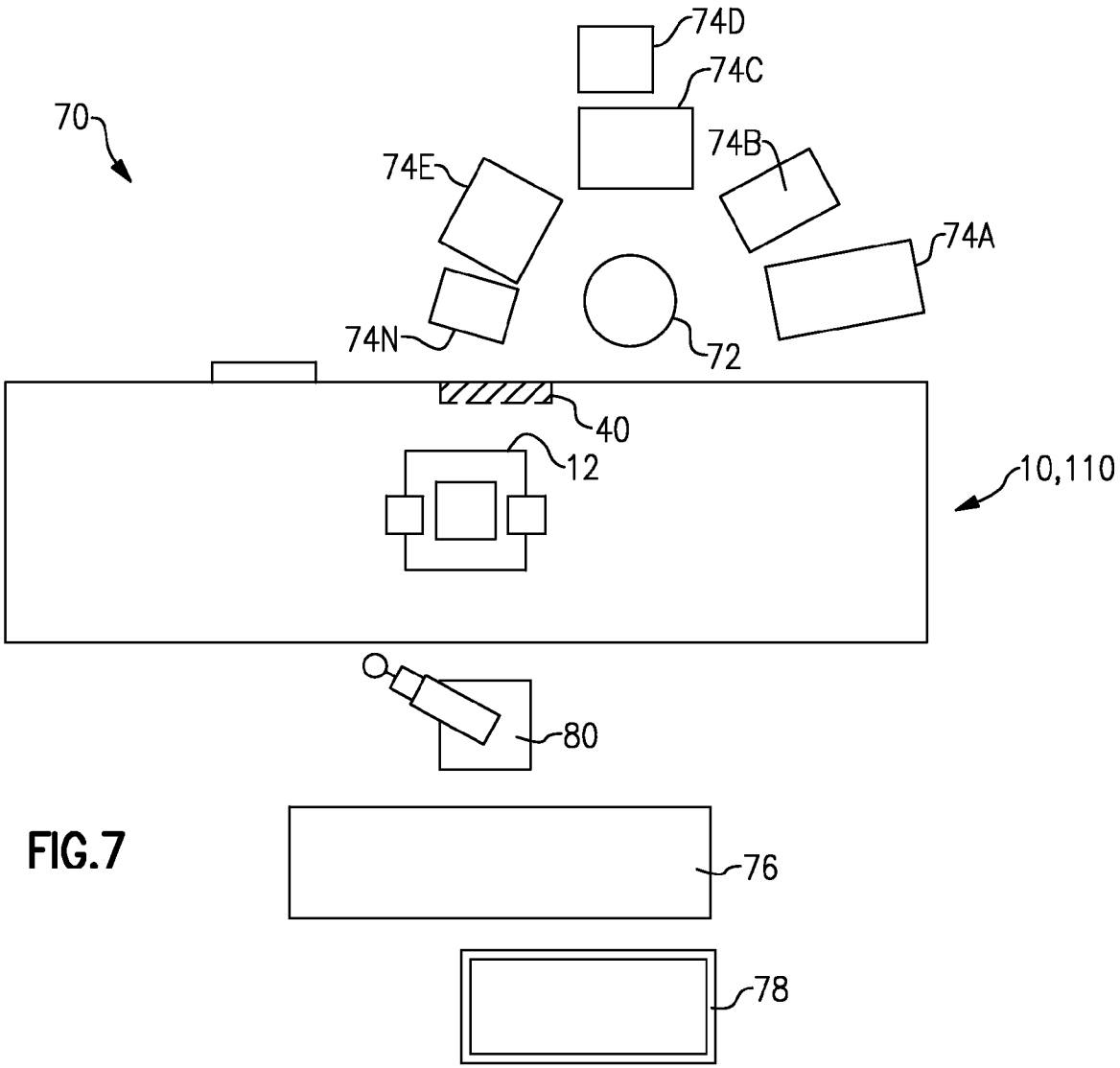
FIG. 7 illustrates an example die casting cell.

FIG. 7 illustrates an example die casting cell 70 for manufacturing and performing secondary operations on cast components. The die casting cell 70 includes a die casting system, such as the die casting system 10 or 110, at least one mechanism 72 and at least one post-cast station 74 for performing a secondary operation on the cast component.

Although a single mechanism 72, such as a robot, is depicted, the die casting cell 70 could include a plurality of robots for performing secondary operations and other tasks associated with the die casting process. The operations the robot 72 can conduct include, but are not limited to, removal of a component from the die 12, inspection of the die casting system 10, 110 via visible light, infrared, ultraviolet or laser light inspection, applying mold release agents to the die 12, etc. The robot 72 may enter the die casting system 10, 110 through the isolation valve 40 to remove a component from the die 12.

The die casting cell 70 includes one or more post-cast stations 74A-74N positioned in relative close proximity to the die casting system 10, 110. In one example, each post cast-station 74A-74N is positioned directly adjacent to the die casting system 10, 110 to reduce the travel distance for the robot 72 or other operator. The post-cast stations 74A-74N can include, but are not limited to, one or more of the following post-cast stations: a cooling station, a gate cut-off station, a belt grinding station, a grit blast station and an inspection station.

As an example of a potential post-cast procedure, the robot 72 may move the component to a cooling station 74A once cast and removed from the die 12. The cooling station 74A can be stationary or moving, and can include a controlled or uncontrolled thermal gradient. After the component cools, the robot 72 moves the component to the gate cut-off station 74B. The gate cut-off station 74B may utilize a dry or wet cut-off wheel, a plasma torch, a wire or plunger electrical discharge machining (EDM), a laser system or any other cut-off system or combination of cut-off systems to remove the gate(s) or other parts from the component.

Next, the robot 72 moves the component to the belt grinding station 74C where cut-off surfaces of the component are smoothed and sharp edges are rounded. After the component is blended to its correct dimensions, the robot 72 moves the component to the grit blast station 74D to prepare the component for visual and non-destructive testing (NDT) inspections. Finally, the component is moved to the inspection station 74E. The inspection station 74E can include dimensional inspection and visual inspection. Other post-cast stations 74N can also be included.

Each of the post-cast stations 74A-74N may be carried out by an individual robot 72 positioned at each station or by a single robot 72 within the die casting cell 70. The number of robots 72 required will be dictated by the size of the robots 72, the operating circle of the robots 72 and the load limits of the robots 72. Alternatively, one or more of the post-cast stations 74A-74N may be operated by a human operator, if desired.

The die casting cell 70 could further include a die storage oven 76, a power supply 78 and a pallet changer 80 for loading the die 12 and/or other parts of the die casting system 10, 110. The power supply 78 supplies power to the die casting cell 70. The die storage oven 76 is positioned immediately adjacent the pallet changer 80 for ease of die loading.

The die storage oven 76 maintains the temperature of the die 12 between 250° F./121° C. and 1500° F./850° C. The die storage oven 76 may operate in air or in an inert atmosphere. Secondary die heating or cooling devices can also be utilized to heat the die parts, including but not limited to, combustible fuel burner systems, re-circulating oil systems, electric cartridge heaters, low temperature resistance heating elements, silicone carbide heating elements, molybdenum discilicide heating elements, graphite heating elements, induction coils or any combination to these or other devices.

The example die casting systems 10, 110 and the die casting cell 70 described above could include more or fewer sections, stations, parts and/or components. This disclosure extends to all forms of die casting, including but not limited to horizontal, inclined or vertical die casting systems and other die casting configurations.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method of manufacturing a component in a die casting cell that includes a die casting system, comprising:

isolating a first chamber from a second chamber of the die casting system using an isolation valve;

melting a charge of material in the first chamber;

sealing the second chamber relative to the first chamber; and simultaneously injecting the charge of material by actuating a shot tube plunger within the second chamber to cast the component and melting a second charge of material within the first chamber.

2. The method as recited in claim 1, comprising the steps of:

removing the component from the die with a robot;

delivering the component to a post-cast station with the robot; and performing a secondary operation on the component at the post-cast station.

3. The method as recited in claim 2, wherein the secondary operation includes removing a gate from the component at a gate cut-off station.

4. The method as recited in claim 2, wherein the secondary operation includes grinding the component at a belt grinding station.

5. The method as recited in claim 2, wherein the secondary operation includes subjecting the component to a grit blast station.

6. The method as recited in claim 2, wherein the secondary operation includes inspecting the component at an inspection station.

7. The method as recited in claim 1, comprising the step of:

melting the charge of material into molten metal with at least one electron beam melting gun.

8. The method as recited in claim 7, wherein the step of melting includes:

preheating the charge of material with the at least one electron beam melting gun;

focusing a beam of the at least one electron beam melting gun onto a tip of the charge of material; and melting the charge of material into a crucible.

9. The method as recited in claim 8, wherein the step of melting includes:

superheating the charge of material within the crucible.

10. The method as recited in claim 1, comprising the step of:

applying a vacuum to the first chamber and the second chamber.

11. The method as recited in claim 10, comprising:

opening the isolation valve after the step of applying the vacuum to reach equilibrium between the first chamber and the second chamber.

12. The method as recited in claim 11, comprising:

after equilibrium is reached, performing the step of simultaneously injecting the charge of material and melting the second charge of material.

13. The method as recited in claim 1, wherein the step of isolating includes:

closing the isolation valve to separate the first chamber from the second chamber.

14. The method as recited in claim 1, wherein the step of sealing includes:

closing a shut-off mechanism to seal a shot tube of the die casting system from a melting system of the die casting system.

15. The method as recited in claim 1, wherein the step of melting includes:

communicating the charge of material to the first chamber; and positioning the charge of material relative to a melting unit.

16. The method as recited in claim 1, wherein the step of simultaneously injecting the charge of material within the second chamber to cast the component and melting the second charge of material with the first chamber includes:

actuating the shot tube plunger to force the charge of material into a die of the die casting system within the second chamber; and melting the second charge of material with a melting unit housed in the first chamber.

17. The method as recited in claim 1, wherein the isolation valve is a separate component from the shot tube plunger.

18. The method as recited in claim 1, comprising:

after solidification of the component, venting the second chamber; and opening the isolation valve to remove the component from the die casting system.

* * * * *